United States Patent [19]

Landry

[11] 4,243,118

[45] Jan. 6, 1981

[54] NON-CONDUCTIVE SAFETY LINE AND METHOD

[76] Inventor: Milton E. Landry, 601 Sadie Ave., Metairie, La. 70003

[21] Appl. No.: 17,286

[22] Filed: Mar. 5, 1979

[51] Int. Cl.[3] ..... A62B 35/00

[52] U.S. Cl. ..... 182/3; 182/46; 174/137 R; 156/145

[58] Field of Search ..... 182/3, 4, 46, 5–8; 174/137 R, 137 A, 137 B, 138 D; 156/48, 145

[56] References Cited

U.S. PATENT DOCUMENTS

| | | | |
|---|---|---|---|
| 1,038,473 | 9/1912 | Alsberg | 174/137 R |
| 2,412,895 | 12/1946 | Lewis | 182/3 |
| 3,830,953 | 8/1974 | Wood et al. | 156/48 |
| 3,876,487 | 4/1975 | Garret et al. | 156/48 |

*Primary Examiner*—Reinaldo P. Machado
*Attorney, Agent, or Firm*—C. Emmett Pugh & Associates

[57] ABSTRACT

A non-conductive safety line and method for producing the safety line is disclosed. The safety line of the preferred embodiment comprises a rope core which has an exterior tubing positioned over the rope core with a quantity of filler material contained within the exterior tubing to completely capsulate the rope core. End loop splices are formed on the rope core ends and a pair of shrinkable tubing sections are positioned over the end loop splices. The completed safety line has a film applied to the exterior thereof to prevent surface wetting. The safety line may be used in conjunction with aerial buckets or hot boards from a lineman's body belt to the boom of an aerial lift or platform of an insulated hot board. The line maintains dielectric integrity, wet or dry, preventing shorting of the lineman's insulation from ground as conventional safety lines can do. The method disclosed teaches the formation of the safety line and the application of the filler to the inside of the exterior tubing surrounding the rope core and the ultimate curing of the safety line in a predetermined position as desired by the user.

12 Claims, 9 Drawing Figures

NON-CONDUCTIVE SAFETY LINE AND METHOD

BACKGROUND OF THE INVENTION

This invention relates generally to safety lines and more particularly to a new and improved non-conductive safety line that may be used in the electrical industry as a simple rope-like link having strength and high dielectrical quantities that remain stable even when moist or wet.

While working on or around high-voltage equipment, rigid tools having appropriate insulation or flexible non-insulated or poorly insulated lines ae used to facilitate work on the energized equipment. Among these flexible lines or straps are what is known as safety lines which are utilized for persons working aloft. Safety lines are usually fastened around the worker's waist with the other end attached to some sturdy member in order to arrest a fall should the worker fall.

Whenever a power line is pulled, held, tied off or handled in any manner by the worker, an insulated device of some sort is generally used to hold the line temporarily. Prior art type devices will not perform safely under wet or dry conditions and are generally not flexible enough to permit ease of handling. In addition the prior art devices cannot maintain strength and dielectric properties under adverse whether conditions in order to prevent shorting of the lineman's insulation from ground as conventional lanyards can do. It is desirable for a safety line to be able to maintain a dielectric strength of 45KV per foot after prolonged submersion in at least two-and-a-half feet of water while still being able to maintain a minimum breaking strength of 3,500 pounds.

Many prior art type synthetic ropes, slings and lanyards presently on the market are good dielectrically when dry, free of dirt and other work environment contaminents. However, when wet due to rain or condensation, they are completely shorted by moisture which is absorbed into and between strands of the lineman's composition.

When working with high-voltage components, the majority of utility companies use aerial lift bucket trucks with insulating liners inside the buckets. This liner is used as a secondary or back-up insulation to the lineman's primary insulation which is rubber gloves. The liners are quite costly and a majority of utilities using these liners dielectrically test them periodically as required by various regulations.

The federal government OSHA regulations do require lanyards or safety lines from the boom of the truck to the lineman's safety belt but these safety regulations do not specify that these lanyards must have dielectric strength.

When a lineman is performing line work out of a bucket truck, his insulation from ground is (1) the rubber gloves, (2) the bucket liner, and (3) the fiberglass boom. Since the federal OSHA regulations require lanyards attached from the man to the boom, the lanyard must maintain its dielectric integrity or the secondary insulation provided by the liner is shorted out and the lanyard will connect the man electrically to the boom resulting in bypassing the first and second insulation components, leaving the third (fiberglass boom) as the only protection.

Other considerations with respect to the need for an electrically sound lanyard is the possibility of contact to grounded objects such as trees, cross-arms, pole, and pole ground wire when working live lines. In addition accidental contact of lanyards can be made to opposite phases from which the man working again resulting in serious injury and/or death.

By referring to FIGS. 1–3 of the drawings there is shown illustrations of the beforementioned dangers. For example in FIG. 1 there is shown the condition of an electrical worker working in an aerial bucket in the rain with the aerial bucket 10 being attached to an insulated aerial boom 12. The worker 14 is shown working on a high-voltage wire 16 and has connected to his waist a safety line 18 which is also connected to the insulated aerial boom 12. In the example shown the safety line 18 may accidentally come in contact with a tree 20 which would electrically ground the safety line causing serious injury to the worker 14.

In FIG. 2 is shown another condition wherein the worker 14 is standing on an insulation hot board 22 which is mounted on a power pole 24. The worker 14 is working on a high-voltage wire 26 while he has his safety line 18 attached to the insulated hot board 22 as shown in the drawing. In this situation the worker 14 may be accidentally grounded as his safety line 18 contacts a second high-voltage wire 28 of opposite polarity resulting in injury and/or death.

In FIG. 3 of the drawing there is shown a situation wherein an energitized high-voltage wire 30 is connected to a grip 32 which is used to pull up and hold the high-voltage wire 30 as desired. The grip 32 is connected to an insulated safety line 18 which is in turn connected to a cable block 34 and ultimately to the pole 36 through the X arm 38. The safety of the application is dependent upon the insulating qualities of the insulated safety line 18 of the prior art type.

Attempts to find completely waterproof insulating safety lines available on the market were unsuccessful. Various prior art lines were claimed to be dielectrically sound under wet conditions, but when wetted and submitted to high voltages, these lines failed electrical wetting tests. Various synthetic layer coatings such as rubber and silicone coating were applied to these prior art safety lines; however, none of these coatings stopped water penetration in and between the fibers of the safety line and ultimately failed dielectric tests when wet.

Attempts were also made to coat a poly-dacron line with an air cured filler and covering that line with a soft poly-vinyl sleeve. This attempt failed because the filler would not cure unless exposed to the atmosphere and also because the poly-dacron fibers were too fine to prevent capillary action of water when submerged.

A prior art search of pertinent patents was conducted in the U.S. Patent Office and the following United States and foreign patents were uncovered as a result of that search:

| Patent Number | Country |
|---|---|
| 1,167,125 | United States |
| 2,683,185 | United States |
| 2,750,152 | United States |
| 2,997,529 | United States |
| 1,282,731 | France |
| 1,395,704 | France |
| 775,112 | Great Britain |
| 775,773 | Great Britain |

None of the above patents cited were directed to the applicant's non-conductive safety line but appeared to be directed to suspension lines, lineman's poles, are the like. In addition none of the references disclosed the concept of utilizing a rope with a covering sleeve in which a dielectric ompound was injected into spaces between the sleeve and the rope which is taught by the applicant's invention.

SUMMARY DISCUSSION OF THE INVENTION

In order to overcome the problems inherent in the prior art type devices there has been provided by the applicant's invention as shown in the embodiment typified, a coarse rope core having exterior tubing positioned over the rope core and having a dielectric filler compound contained within the exterior tubing and completely encapsulating the coarse rope core. The applicant's safety line may be cured in any given position such as a straight line or in a coiled position and would have a pair of loop splices formed on each end of the rope core with a pair of shrinkable tubing sections positioned over the end loop splices and over the ends of the exterior tubing. In addition the applicant's safety line would then have a silicone type film applied to the exterior of the safety line to prevent surface wetting of the line.

In the formation of the safety lines, the filler compound may be applied to the interior of the exterior tubing either under pressure in order to force air out ahead of the filler being introduced into the exterior tubing or under a vacuum which would remove air and cause the filler to replace the air inside the exterior tubing. In addition it may also be applied by extrusion and by other means within the spirit and scope of the invention.

Accordingly it is an object and advantage of the invention to provide a new and novel non-conductive safety line and method for producing the safety line with the safety line being usable around high-voltage lines and not being effected by moisture and also being dependable to maintain its electrical properties consistently even when exposed to moisture.

Another object and advantage of the invention is to provide a new and novel non-conductive safety line and method for producing the safety line such that the safety line will not be electrically effected by humidity or moisture even when wetted or used in rain.

Still yet another object and advantage of the invention is to provide a new and novel non-conductive safety line and method of producing the safety line wherein the safety line is so capsulated and impregnated with a non-conducting material as to have no capillary or absorption tendencies within the line proper.

Yet another object and advantage of the invention is to provide a new and novel non-conductive safety line and a method for producing the safety line wherein the impregnated material contained within the safety line may be applied under a pressure or a vacuum to the line so that air within the line is excluded and so that the impregnating material will solidify into a flexible non-water-absorbing dielectric filler between all strands of the rope being used.

Still yet another object and advantage of the invention is to provide a new and novel non-conductive safety line and method for producing the safety line wherein the impregnating material may be applied by pressure-pumping, vacuum filling or extrusion so as to create a void-free rope completely saturated in rubber or a dielectric compound or other similar compound.

A further object and advantage of the invention is to provide a new and novel non-conductive safety line and a method for producing the safety line which contains an insulating jacket over the compounded line to prevent contamination and to allow a non-wetting agent such as silicone or the like to be used to prevent a film of moisture or wetness bridging the outside surface of the safety line thereby aiding in maintaining the dielectric strength even in rain since the water beads on the silicone surface instead of filming the surface.

These and other objects and advantages of the invention will become apparent from a review of the complete application and from a review of the drawings of the application showing one embodiment of the invention.

DESCRIPTION OF PREFERRED EMBODIMENT

Figure 4:
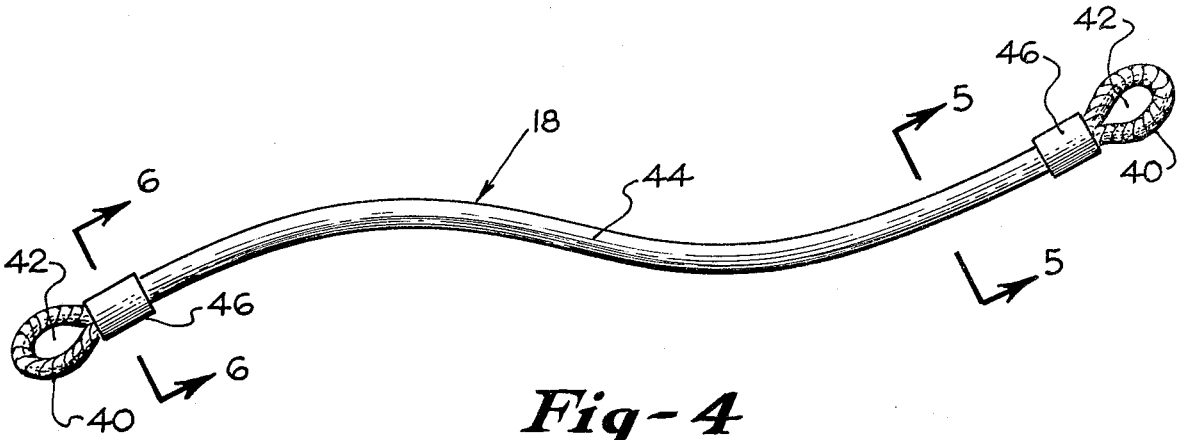
FIG. 4 is a plan view of the applicant's new and novel safety line.

Referring to the drawings in general and in particular of FIG. 4 of the drawing there is shown the applicant's new and novel non-conductive safety line 18 which comprises a rope core 40 which has formed on each end thereof a pair of end loops 42 which are spliced into the rope core 40 by means known in the art. The safety line 18 is formed with an exterior tubing 44 which is positioned over the rope core 40 and has a pair of shrinkable tubing sections 46 positioned over the ends of the exterior tubing 44 and over the end loop splices formed in the end loops 42.

Figure 5:
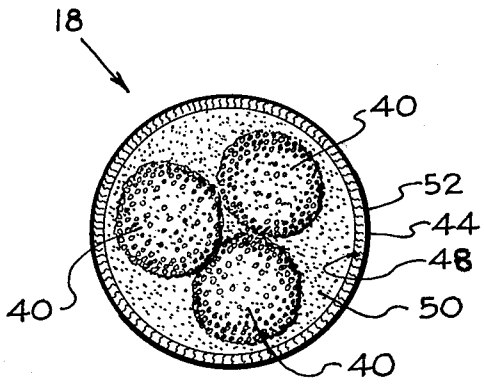
FIG. 5 is a sectional view, taken along line 5—5 of FIG. 4 showing a cutaway of the applicant's new and improved safety line.

Referring now to FIG. 5 of the drawing there is shown a sectional view, taken along line 5—5 of FIG. 4, showing in further detail the interior of the applicant's safety line 18. The rope core 40 may be formed in one or more strands and in the embodiment shown it can be seen that the rope core 40 is formed with three strands of non absorbing coarse rope material which are woven together as is well known in the rope art and has an exterior non absorbing tubing 44 positioned over the rope core. Contained between the interior surface 48 of the exterior tubing 44 and the rope core 40 is a filler 50 which may be formed of a dielectric compound such as of example a non-combustive rubber, in the embodiment shown and may also be formed of other electrical insulating compounds compounds of the type known in the art. The strands forming the rope core 40 are formed of crease non absorbing filaments so that whenever the filler 50 is positioned within the exterior tubing 44 by means of the method hereinafter described, the filler 50 will completely capsulate the rope core 40 as will also be hereinafter described.

The completely safety line 18 would have applied to the exterior surface 52 of film of silicone or some other non conducting material for the purpose which will be more fully explained hereinafter.

Figure 6:
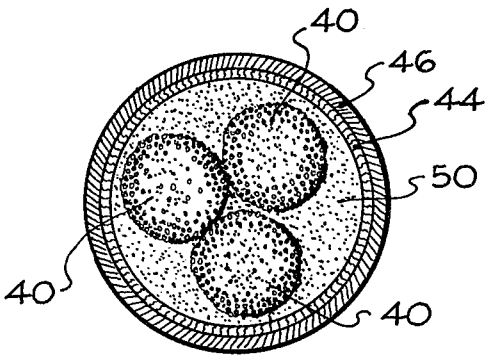
FIG. 6 is a sectional view, taken along line 6—6 of FIG. 4, showing a cutaway of the end loop splices of the applicant's new and improved safety line.

By referring now to FIG. 6 of the drawing there is shown a cross-sectional view, taken alone lines 6—6 of FIG. 4 showing in more detail the end loop splices in the ends of the safety line 18 and the positioning of the shrinkable tubing sections 46 over the exterior tubing 44. It will be recognized that because of the particular nature of splicing the ends of the rope into end loops 42 that the exterior tubing 44 will not be able to extend completely to the beginning of the end loops and therefore it is necessary to apply the shrinkable tubing sections 46 to cover the ends of the exterior tubing 44 and also the complete splice at the ends of the safety line 18. This is shown in further detail in FIG. 7 of the drawing where the ends 54 of the exterior tubing 44 are shown with dashed lines and the covering of the shrinkable tubing sections 46 over the ends 54 as well as the completed splice 56.

When completed thusly the safety line 18 comprises an impregnated rope which is covered with a flexible non-conducting jacket that is coated with a silicone spray or grease in order to prevent external wetness. The rope core 40 that is selected must have good high dielectrical qualities when dry with the fibers being coarse so as to permit a full impregnation of the rope core which would avoid all capillary or wicking action after impregnation of the filler 50. The waterproofing process herein described of the safety line 18 does not effect the mechanical or electrical strength of the rope core 40 and it only stabalizes the rating of the rope core under all weather conditions.

In the manufacture of the safety line 18 it must be manufactured in such a manner where moisture is not entrapped in the line during the processing of the line. The filler 50 that is selected for introduction into the center of the exterior tubing 44 should be used in its initial liquid state and may be applied to the rope core 40 in at least one of three methods. It may be applied under pressure in order to force air out ahead of the incoming filler 50 and it may also be applied under a vacuum in order to remove air and to cause the filler 50 to replace all air entrapped within the exterior tubing 44. In addition it may also be applied by means of extrusion where the rope and filler would be extruded through dies in order to press the filler into the rope core 40.

By referring back again to FIG. 7 of the drawing, there is shown an illustration of the first mentioned method of introducing the filler into the exterior tubing 44 which would consist of a pressure method wherein the filler 50 would be carried in a reservoir 58 and would be introduced into the interior of the exterior tubing 44 by means of the hand pump 60 and through the nozzle 62 which had previously been positioned through a perforation 64 made in the exterior tubing 44.

After the filler 50 has been forced into the inside of the exterior tubing 44 by one of the methods above described or by other methods known in the art, the filler would then be allowed to cure or harden into a rubbery, flexible link with the rope core 40 being completely incased. The filler 50 would be formed of rubber or a rubber base compound such as a natural or synthetic rubber and would be either self-curing or a catalyst type within the spirit and scope of the invention. It should have good penetration qualities and very high dielectric qualities which would not affect the rope strength and would cure to an elastic non-hardening rubber-like compound. It is also within the spirit and scope of the invention that the filler could be formed of other materials having non-electrical conducting qualities of the types well known in the art.

The exterior tubing 44 would be formed of a flexible synthetic tube which would have an inside diameter large enough for insertion over the rope core 40 and would further have an outside diameter of whatever would be commercially available in the market place. The exterior tubing 44 would also be a non-conductive material when dry and would cover the rope core 40 from the end splice 56 to the opposite end splice 56.

Figure 7:
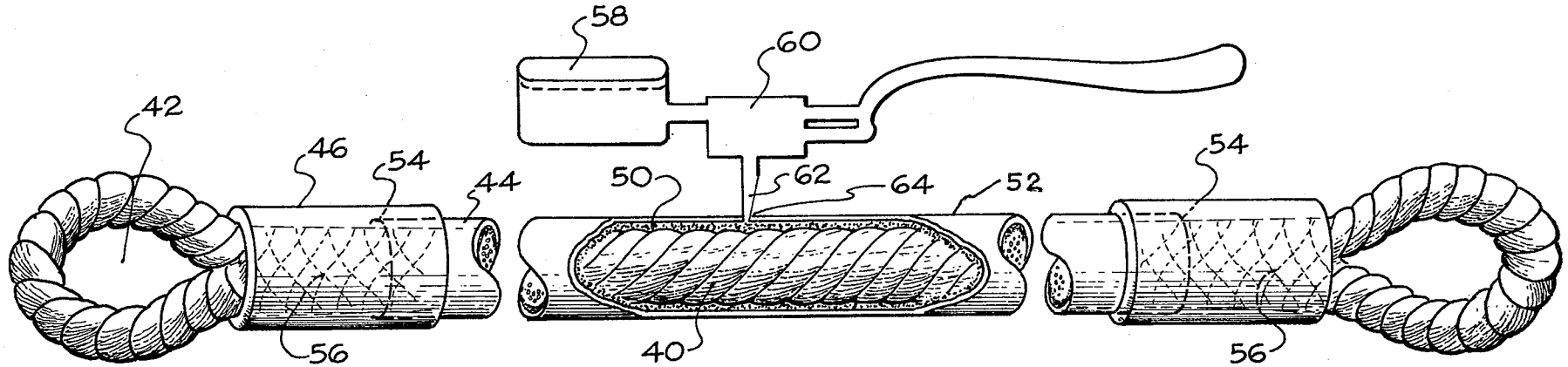
FIG. 7 is a partial plan view of the applicant's new and improved safety line showing one method of formation of the capsulated rope of the invention.

The shrinkable tubing sections 46 of the invention would be formed of a poly-vinyl-chloride or the equivalent and would be positioned as shown in FIG. 7 of the drawing in order to partially close the ends of the exterior tubing 44 and to protect the end loop splices as also shown in the drawing. In the manufacture of the safety line 18 its length would be determined by the respective requirements of the purchaser of the line and the rope core length would be this length plus sufficient extra length for the end loops 42 to be spliced at each end of the safety line 18.

In one manufacturing method of the subject invention an end loop 42 would be formed in one end of the rope core 40 by splicing with the exterior tubing 44 being slipped over the remainder of the rope core 40. The two heat-shrinkable tubing sections 46 would then be slid over the exterior tubing 44 and the second end loop 42 would be spliced on the other end of the rope core 40.

Thereafter the heat-shrinkable tubing sections 46 would be heat-shrunk partially over the ends of the exterior tubing 44 and partially over the splice forming the end loops 42 on each end.

In order to position the filler 50 within the exterior tubing 44 a small pumping hole 64 would be drilled through the wall of the PVC tubing and the filler 50 would be pumped under pressure through that hole as shown in FIG. 7 of the drawing. The filler 50 may be a catalyst type compound as for example that sold under the trademark "RTV" by Dow Corning Corporation or may be other types of compounds as has been before mentioned. The pumping pressure forces the filler to fill all voids in both directions along the length of the rope core 40 and the pumping would be stopped when sufficient filler material had filled all voids visible within the assembly. The exterior tubing 44 in the embodiment shown would be preferably formed of a clear PVC tubing in order to be able to view the filling of the voids within the rope core 40.

Before the filler 50 starts to cure after being completely filled within the exterior tubing 44, the safety line would be positioned in a desired position, such as in a straight line position or possibly in a coiled position as would be desired by the ultimate user of the safety line. When positioned in a straight line the curing of the filler 50 would prevent curling or spiralling of the safety line and the safety line would then be dielectrically and mechanically tested after curing. The cure rate would depend upon the exact catalog number of the filler used and the speed of curing required would depend upon manufacturing and handling techniques.

By the application of the methods described, the safety line 18 may be formed in any desired configuration prior to the curing such as a perfectly straight line which would cure perfectly straight and should it be desired that the safety line 18 be formed in a final coiled position, then the safety line would tend to maintain a coiled position when cured in that position.

Other known filler compounds 50 may be rubber compounds of the catalyst type as manufactured by the General Electric Company and known in the trade as "silastic" compounds.

In the manufacture of the applicant's safety line, the success of the safety line in preventing moisture absorption due to capillary action is by the utilization of a coarse filament line and by the introduction of the filler material into the line under pressure or vacuum to completely capsulate each strand and to drive all air voids outward toward the ends of the rope core 40. By removing all air in the formation of the safety line, water or moisture will not migrate through the line thereby shorting it out and endangering the worker to electrical shock or death.

Figure 1:
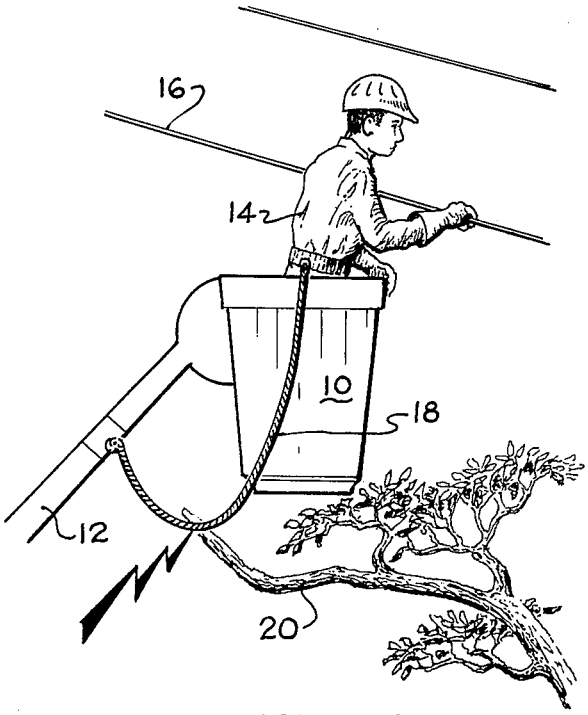
FIGS. 1–3 are pictorial representations of various hazardous conditions which electrical workers are exposed to when utilizing safety lines.
Figure 2:
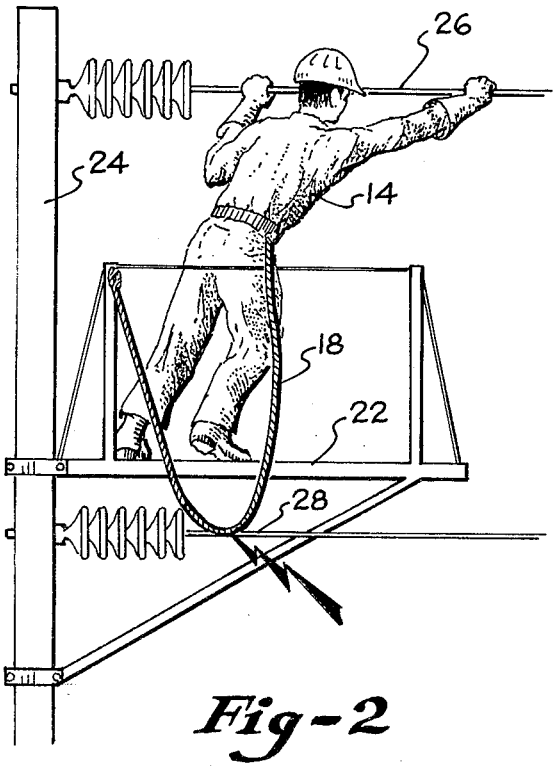
Figure 3:
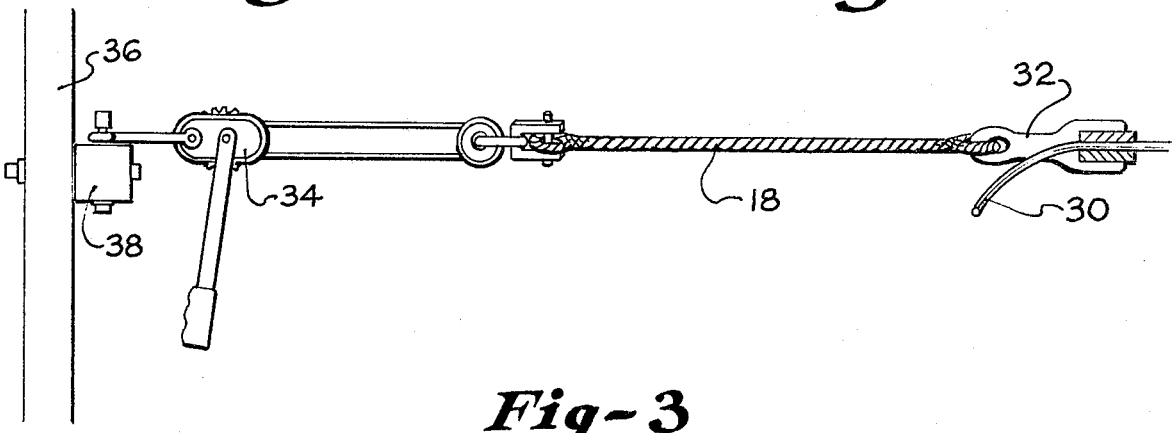

After the assembly of the safety line is complete as hereinbefore mentioned, it would be sprayed with a silicone spray of the types used on automobile ignition systems or would be wiped with a silicone grease which is available and non conducting. After application of of the silicone, all traces of the silicone would be wiped off from the exterior surface 52 of the safety line 18 leaving an infinitely small amount of film to prevent surface wetting of the safety line. By causing all water to bead or roll off the exterior surface 52, the safety line 18 would not be shorted by external wetting caused by the various type applications shown in FIGS. 1–3. Sections of the exterior tubing 44 could be damaged and even some filler 50 be lost in the area where the damage occurred but the safety line 18 would only become subject to local wetting at those damaged areas and would still be serviceable until extensive damage would occur to the safety line.

In actual sample tests run after curing of the safety line 18, it has been found the process leakage currents at 40 KV A.C. will remain the same whether the safety line 18 is dry or wetted by soaking for as much as thirty days in a tank of water. In addition, sample tests in actual field test conditions under all weather conditions demonstrated that the applicant's new and novel safety line 18 performed as designed and the object of the non-conducting safety line for use on high-voltage equipment was achieved.

Figure 8:
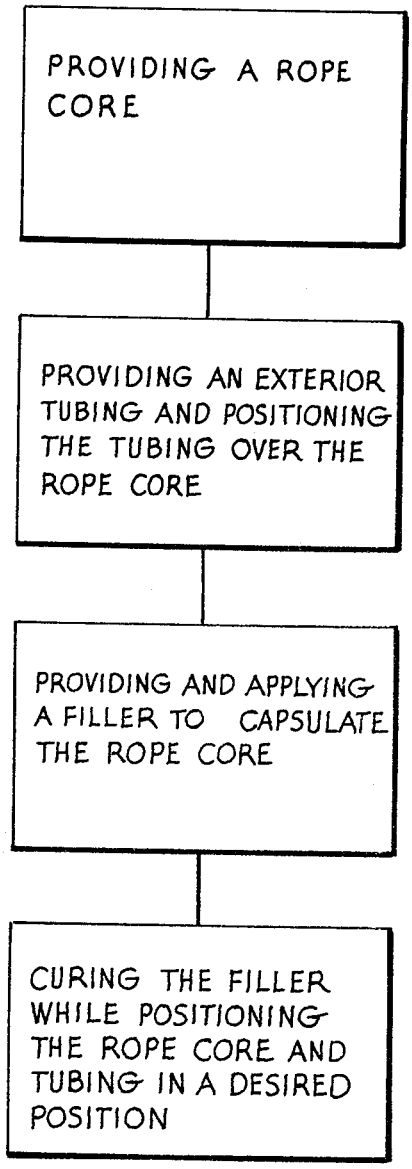
FIG. 8 is a block diagram showing the applicant's basic method for producing a non-conductive safety line.
Figure 9:
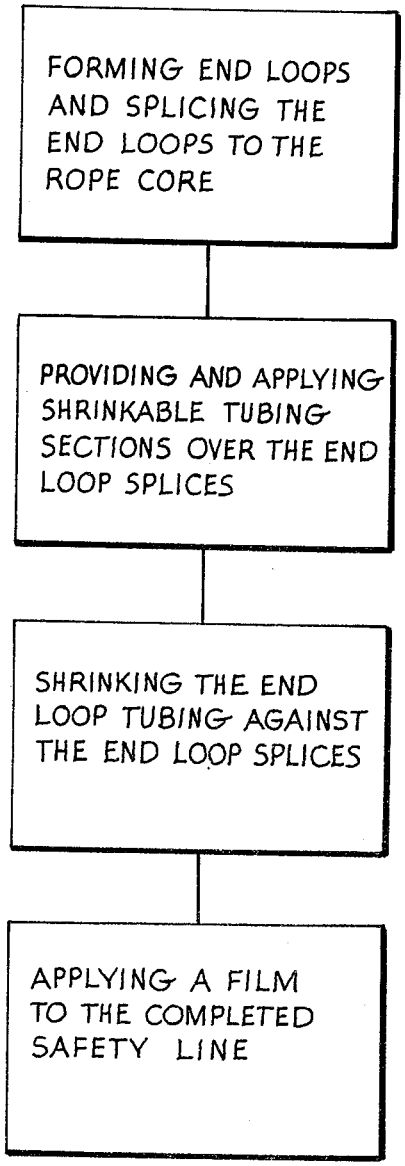
FIG. 9 is a block diagram showing the additional step of the applicant's basic method wherein the non-conductive safety line may be formed with end loops as outlined in the method and with a film applied to the safety line.

By referring now to FIG. 8 of the drawing there is shown the applicant's new and novel method of producing the non-conductive safety line 18 which comprises the steps of providing a rope core and thereafter providing an exterior tubing of predetermined size and positioning the tubing over the rope core. A filler is then provided and applied to the inside of the exterior tubing 44 to completely capsulate the rope core 40 and to drive off all air voids to the atmosphere. Thereafter the filler material 50 would be cured for a predetermined time while positioning the rope core and the tubing in a desired position. In this manner the basic method of the applicant's invention would be practiced in order to provide the basic safety line construction 18 in one embodiment of the method. Should it be desirable to utilize the basic safety line as beforementioned, then reference would be made to FIG. 9 to understand the completion of the safety line to the type which could be utilized by an electrical worker. The previously cured safety line 18 would then have end loops formed on the safety line and spliced to the rope core whereupon the heat-shrinkable tubing sections 46 would be provided and applied over the end loop splices. Thereafter the shrinkable tubing would be tightly shrunk against the end loop splices and the film of silicone or other material would be applied to the completed safety line to prevent surface wetting on the exterior of the safety line.

From the foregoing it can be seen that there has been provided by the subject invention, a new and novel non-conductive safety line and method for producing the safety line which completes all of the objects and advantages of the invention. It should become apparent that changes may be made in the safety line and in the method for manufacturing the safety line as disclosed in the embodiment shown and it is within the spirit and scope of the invention that these changes would be within the purview of the applicant's invention. It should also be understood that the embodiment shown and described herein has been shown by way of illustration only and the applicant's invention is not to be limited to the exact embodiment shown.

Finally, it should be understood that the term "rope" as used herein, unless otherwise noted, is not to be restricted to any particular type of material, such as the natural materials of for example hemp or manila or sisal but also synthetic materials such as for example nylon, "Dacron", glass fibers, "Saran" and polyethlene synthetics, or to any particular type of weave or construction and could conceivably include for example wire rope or cable, as long as the material or construction is rendered electrically non-conductive and non-porous from end portion to end portion. However, the most preferred material is a rope made of non porous synthetic type material. Additionally, it should be understood that the term "rope" as used herein, unless otherwise noted, is not to be restricted to a woven or twisted material but could be formed of one single continuous material or structure, and that should structure need not have a circular cross-section but for example could be in the form of a flat belt. What is important is that the "rope" or central core material have sufficient strength to withstand the loads involved and be of such a nature as not to be electrically conductive in use.

Having described my invention, I claim:

1. A method of producing a non-conductive safety line, comprising the steps of:

(a) providing an elongated rope core;

(b) providing an exterior tubing of pre-determined size and positioning the tubing over the rope core;

(c) providing and applying a filler to the inside of the tubing at a pre-determined location to completely capsulate the rope core and to drive off all air voids to the atmosphere;

(d) curing the filler for a pre-determined time;

(e) forming end loops on the cured safety line and splicing the end loops to the rope core;

(f) providing and applying a shrinkable tubing over the end loop splices;

(g) shrinking the end loop tubing tightly against the end loop splices; and (h) applying a film to the completed safety line to prevent surface wetting on the exterior of the safety line.

2. The method as defined in claim 1 wherein in step "a" there is further included the step of making the rope core of strands of non-conductors and non-absorbing coarse filaments.

3. The method as defined in claim 1 wherein in step "d" there is further included the step of using the filler a non-conductive rubber compound.

4. The method as defined in claim 1 wherein in step "d" there is further included the step of positioning the rope core and tubing in a coiled position while the filler is curing.

5. The method as defined in claim 1 wherein in step "d" there is further included the step of positioning the rope core and tubing in a straight line position while the filler is curing.

6. The method as defined in claim 1 wherein in step "c" there is further included the step of applying the filler under a pressure to force air out ahead of the filler being introduced into the exterior tubing.

7. The method as defined in claim 1 wherein in step "c" there is further included the step of applying the filler under a vacuum to remove air and causing the filler to replace the air inside the exterior tubing.

8. The method as defined in claim 1 wherein in step "c" there is further included the step of applying the filler by extrusion.

9. A non-conductive safety line, comprising:

(a) an elongated rope core having a pair of ends;

(b) end loop splices formed on the rope core ends;

(c) an exterior tubing positioned over the rope core and having a pair of ends;

(d) a filler contained within the exterior tubing and completely capsulating the rope core;

(e) a pair of shrinkable tubing sections positioned over the end loop splices and over the ends of the exterior tubing; and (f) a film on the exterior of the safety line, preventing surface wetting.

10. The safety line as defined in claim 9 wherein the rope core is made of strands formed of non absorbing, non conducting coarse filaments.

11. The safety line as defined in claim 9 wherein the filler comprises a dielectric compound.

12. The safety line as defined in claim 9 wherein the film applied to the exterior of the safety line is a silicone or equivalent.

* * * * *